US006481348B2

(12) United States Patent
Yoshizawa et al.

(10) Patent No.: US 6,481,348 B2
(45) Date of Patent: Nov. 19, 2002

(54) OBJECT ATTACHMENT APPARATUS FOR PRINTING CYLINDER

(75) Inventors: Kohji Yoshizawa, Kawasaki; Mutsuhito Yoneta, Tokyo; Mitsuo Kitai, Yokohama, all of (JP)

(73) Assignee: Tokyo Kikai Seisakusho, Ltd., Tokyo (JP)

( * ) Notice: Subject to any disclaimer, the term of this patent is extended or adjusted under 35 U.S.C. 154(b) by 0 days.

(21) Appl. No.: 09/776,856

(22) Filed: Feb. 6, 2001

(65) Prior Publication Data

US 2002/0005131 A1 Jan. 17, 2002

(30) Foreign Application Priority Data

Jul. 6, 2000 (JP) ..... 2000-204893

(51) Int. Cl.[7] ..... B41F 27/12
(52) U.S. Cl. ..... 101/415.1; 101/378
(58) Field of Search ..... 101/415.1, 378, 101/382.1, 383

(56) References Cited

U.S. PATENT DOCUMENTS 2,279,204 A * 4/1942 Neilson ..... 101/415.1
3,016,010 A * 1/1962 Luehrs ..... 101/415.1
6,101,942 A * 8/2000 Robert ..... 101/378
6,131,513 A * 10/2000 Emery ..... 101/415.1
RE36,977 E * 12/2000 Rau ..... 101/415.1
6,378,430 B1 * 4/2002 Eighmy et al. ..... 101/378

FOREIGN PATENT DOCUMENTS

| | | |
|---|---|---|
| JP | 52-6326 | 2/1952 |
| JP | 9-99543 | 4/1997 |
| JP | 2956026 | 7/1999 |

* cited by examiner

*Primary Examiner*—Leslie J. Evanisko
(74) *Attorney, Agent, or Firm*—Armstrong, Westerman & Hattori, LLP

(57) ABSTRACT

A groove for receiving opposite end edges of an object, like a printing plate that extends around a printing cylinder, is formed in a printing cylinder adjacent the outer circumferential surface thereof to extend from an axially extending anchor-shaft hole to the outer circumferential surface of the cylinder body. One wall surface of the groove intersects, at an acute angle, a tangent plane passing through a line of intersection between the wall surface and the outer circumferential surface of the printing cylinder, thereby forming an edge together with the circumferential surface of the printing cylinder. When an anchor shaft inserted into the anchor-shaft hole is rotated by means of elastic force, pins studded into a cutaway surface of the anchor-shaft enter anchor holes formed in an end edge portion of the object and secure the end edge portion within the groove. Thus, the object is attached to the printing cylinder.

2 Claims, 3 Drawing Sheets

OBJECT ATTACHMENT APPARATUS FOR PRINTING CYLINDER

BACKGROUND OF THE INVENTION

1. Field of the Invention

The present invention relates to an apparatus for attaching an object; i.e., a printing plate or a blanket, to a printing cylinder of a printing press (hereinafter referred to as an "object attachment apparatus of a printing cylinder"), and to a printing plate and a blanket which can be attached to the printing cylinder by use of the apparatus.

2. Description of the Related Art

Japanese Patent No. 2956026 discloses a conventional apparatus for winding a printing plate or blanket around the outer circumferential surface of a cylinder of a rotary press to thereby attach the plate or blanket to the cylinder under tension.

The attachment apparatus disclosed in Japanese Patent No. 2956026 will be described. A printing plate or blanket (hereinafter generally referred to as a "plate") to be attached to the cylinder has opposite end portions which are bent at respective angles corresponding to an angle formed between a slit for receiving the opposite end portions and the outer circumferential surface of the cylinder. That is, a first end portion of the plate is bent at an angle substantially equal to an acute angle formed between the slit and the outer circumferential surface of the cylinder, and a second end portion of the plate is bent at an angle substantially equal to an obtuse angle formed between the slit and the outer circumferential surface of the cylinder. Further, a large number of square openings are formed in a leg portion of the second bent end portion.

The apparatus for attaching the plate under tension disclosed in Japanese Patent No. 2956026 has the following structure. An axial-extending slit is formed in the cylinder of the rotary press such that the slit opens at the outer circumferential surface of the cylinder and extends radially inward; an axially-extending hole is formed in the cylinder such that the hole continues from the bottom portion of the slit; and an axially-extending tension spindle is rotatably inserted into the hole.

The plate is attached to the cylinder as follows. The first bent end portion of the plate is inserted into the slit to be located on the acute-angle side of the slit. Subsequently, the plate is wound around the outer circumferential surface of the cylinder, and the second bent end portion of the plate is inserted into the slit and attached to the tension spindle. Upon rotation of the tension spindle, the plate is pulled into the slit from the second end portion side, whereby the plate is attached to the outer circumferential surface of the cylinder under tension.

The means for attaching the second bent end portion to the tension spindle is a strip having a large number of elastic rectangular tongues aligned along the strip, such as a comb-shaped plate spring. The strip is disposed in a groove which is formed in the tension spindle and has a V-shaped cross section. The elastic rectangular tongues enter the large number of square openings of the leg portion of the second bent end portion, and their inwardly-facing surfaces come into engagement with the inner edge portions of the openings. More specifically, the base portion of the strip is fixed to the bottom portion of the groove such that the tip ends of the rectangular tongues project from the outer circumferential surface of the tension spindle and such that the tip ends can bend.

After the tip ends of the tongues have entered the openings at the second bent end portion of the plate upon rotation of the tension spindle, the inwardly-facing surfaces of the tongues come into engagement with the inner edge portions of the openings and move angularly, while bending, upon further rotation of the tension spindle. Thus, the tongues pull the plate into the slit by means of their elasticity, whereby the plate is attached to the outer circumferential surface of the cylinder in a state in which a proper elastic force is applied from the tongues to the second bent end portion of the plate.

When the plate is to be removed from the cylinder, the tension spindle is further rotated in the plate-attaching direction. As a result, the tongues bend such that their dimensions measured in the radial direction decrease, and the tongues disengage from the openings formed at the second bent end portion of the plate, so that the tip end portions of the tongues are released toward the deeper side of the slit. Thus, the tongues recover their original, straight shape.

When the tension spindle is rotated in the reverse direction in this state, the outwardly-facing surfaces of the tongues come into contact with the tip end of the second bent end portion of the plate and push the second bent end portion, so that the second bent end portion of the plate is pushed out of the slit. Thus, a portion of the plate located in the vicinity of the opening of the slit separates from the outer circumferential surface of the cylinder, so that a clearance is formed between that portion and the outer circumferential surface of the cylinder. The thus-formed clearance enables a worker to remove the plate from the cylinder.

The conventional apparatus for attaching a printing plate or blanket to a printing cylinder as disclosed in Japanese Patent No. 2956026 has the following drawbacks.

1. As described above, after the plate to be attached to the cylinder is inserted into the slit formed in the cylinder, the tension spindle is rotated in order to cause the tip ends of the elastic tongues to enter the openings formed in the second bent end portion of the plate. However, if the plate is inserted into the slit with a slight shifting, the tongues fail to enter the openings, because the openings and the tip ends of the tongues each have a square shape, and the relative position between each opening and a corresponding tongue is determined through engagement between opposite side edges of the opening and the opposite side edges of the tongue. In such a case, since the plate cannot be attached, the work of inserting the plate into the slit of the cylinder must be performed again. When the width of the openings formed in the second bent end portion of the plate is increased in order to overcome the above-mentioned problem, the attachment position of the plate varies greatly, which also requires re-performance of the work of inserting the plate into the slit of the cylinder. In either case, the burden imposed on a worker increases.

2. The slit formed in the cylinder is located outside of the tension-spindle insertion hole also formed in the cylinder; one of the side wall surfaces is tangent to the wall surface of the tension-spindle insertion hole; and cutaways extending in the circumferential direction are formed between the slit and the tension-spindle insertion hole at appropriate positions in order to connect the slit and the hole.

The second bent end portion of the plate inserted into the slit is located on the outside of the outer circumference of the tension spindle inserted into the tension-spindle insertion hole.

Subsequently, the plate is pulled toward the deeper side of the slit through use of elastic deformation of the tongues projecting from the outer circumferential surface of the tension spindle. Further, when the tension spindle is rotated further for removal of the plate, the tongues are disengaged from the plate and released toward the deeper side of the slit. Subsequently, the tension spindle is rotated in reverse in order to push the plate out of the slit by means of the tongues.

However, when the tongues attached to the tension spindle bend or deform permanently due to repeated plate attachment/removal operations, there is a possibility that the plate cannot be attached to the cylinder while receiving a constant tension from each of the tongues, due to variation in deformation amounts among the tongues. Further, there is a possibility that the tip ends of some tongues, having deformed greatly, do not come into contact with the plate and become unable to pull the plate into the slit and push the plate out of the slit.

Further, deformation and breakage of the tongues occur at a relatively high frequency, work of replacing the tongues and work for maintaining and inspecting the tension spindle consume a large amount of time, which lowers work efficiency.

Further, the combined shape formed by the slit and the tension-spindle insertion hole is relatively complex, and therefore a prohibitively long time is needed to machine the slit and the tension-spindle insertion hole.

SUMMARY OF THE INVENTION

An object of the present invention is to provide an apparatus for attaching an object (i.e. a printing plate or blanket) to a cylinder of a printing press, which apparatus enables attachment of the object even when the object is inserted into a slit of the cylinder with slight shifting to thereby eliminate the necessity of re-performing the insertion operation.

Another object of the present invention is to provide an apparatus for attaching an object (printing plate or blanket) to a cylinder of a printing press, which apparatus prevents deformation or breakage of a member used for pulling the object toward the deeper side of the slit and pushing the object out of the slit; enables the object to be attached to the outer circumferential surface of the cylinder under constant tension; and can reliably push the object from the slit of the cylinder for removal of the object.

Still another object of the present invention is to provide an apparatus for attaching an object (printing plate or blanket) to a cylinder of a printing press, which apparatus can reduce the frequency of repair, maintenance, and inspection work.

A further object of the present invention is to provide an apparatus for attaching an object (printing plate or blanket) to a cylinder of a printing press, which apparatus can simplify the combined shape formed by a slit and a tension-spindle insertion hole, to thereby facilitate the machining of the slit and the tension-spindle insertion hole.

To achieve the above-described objects, the present invention provides an object attachment apparatus of a printing cylinder which is adapted to anchor edge portions of an object (printing plate or blanket) located at opposite ends thereof in a winding direction of the object, after the object is wound around the outer circumferential surface of the printing cylinder. The object attachment apparatus comprises an anchor-shaft hole, a groove, an anchor shaft, and rotational force imparting means.

The anchor-shaft hole is formed in the printing cylinder in the vicinity of the outer circumferential surface thereof such that the anchor-shaft hole penetrates the printing cylinder in the axial direction.

The groove is also formed in the printing cylinder such that the groove extends outward from the anchor-shaft hole and opens at the outer circumferential surface of the printing cylinder to thereby provide a gap into which the opposite end edge portions of the object can be inserted. One of wall surfaces of the groove intersects, at an acute angle, with a tangent plane passing through a line of intersection between the wall surface and the outer circumferential surface of the printing cylinder, thereby forming an edge together with the outer circumferential surface of the printing cylinder.

The anchor shaft is rotatably inserted into the anchor-shaft hole with a proper clearance formed therebetween. The anchor shaft is partially cut away in order to form an axially extending cutaway, thereby preventing the outer circumferential surface of the anchor shaft from interfering with the object, which is inserted into the groove when the anchor shaft is positioned at a predetermined angular position. The cutaway has first and second surfaces. The first surface faces but is separated from the object when it is inserted into the groove with the anchor shaft being positioned at the predetermined angular position. When the anchor shaft is rotated from the predetermined angular position, the second surface comes into contact with the tip end of the object inserted into the groove. A plurality of pins are studded in the first surface of the anchor shaft such that they are aligned in the axial direction at an interval smaller than the length of the end edge portion of the object. The top end of each pin can engage the object when the anchor shaft is rotated from the predetermined angular position. At least a portion of the outer circumferential surface of the pin facing the second surface side has a curved shape.

The rotational force imparting means imparts a rotational force to the anchor shaft such that the anchor shaft rotates in such a direction that the second surface of the cutaway of the anchor shaft moves away from the opening of the groove and the tip ends of the pins come into contact with the object inserted into the groove.

The present invention further provides an object (printing plate or blanket) which is attached to the printing cylinder by use of the object attachment apparatus of the present invention. The object has plate portions at parallel edge portions at the opposite ends in the direction in which the object is wound around the printing cylinder. One of the plate portions is bent at an acute angle, and the other plate portion is bent at an obtuse angle, which is substantially the supplementary angle of the acute angle. The dimension of the second bent portion in the winding direction is greater than that of the first bent portion, and at least one hole is formed in a portion of the second bent portion exceeding the dimension of the first bent portion. At least a portion of the hole facing the corresponding end edge has a curved shape.

When the object attachment apparatus and the object according to the present invention are used, an operator can attach the object to the printing cylinder even when the object is inserted into the groove of the cylinder with a slight shift to thereby eliminate the necessity of re-performing the insertion operation. Further, the projecting portion of the anchor shaft which engages the object and pulls it to the deeper side of the groove does not deform or break, and the object can be attached to the outer circumferential surface of the printing cylinder under uniform tension.

Further, when the object is to be removed from the printing cylinder, the object can be reliably pushed out from the groove of the printing cylinder through a simple operation. In addition, since the mechanism is simple and does not require frequent repair, maintenance, and inspection work, the burden imposed on a worker can be reduced, and work efficiency can be increased.

Moreover, since the combined shape formed by the anchor-shaft hole and the groove for receiving the end portions of the object is simple, machining of the groove and hole can be facilitated, and costs can be reduced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

An object attachment apparatus of a printing cylinder of a printing press, according to an embodiment of the present invention, will be described with reference to the drawings.

An object attachment apparatus S includes an anchorshaft hole 1*a* and a groove 1*b*, both formed in a printing cylinder P of a printing press; an anchor shaft T inserted into the anchor-shaft hole 1*a*; and rotational force imparting means A for imparting rotational force to the anchor shaft T.

Figure 1:
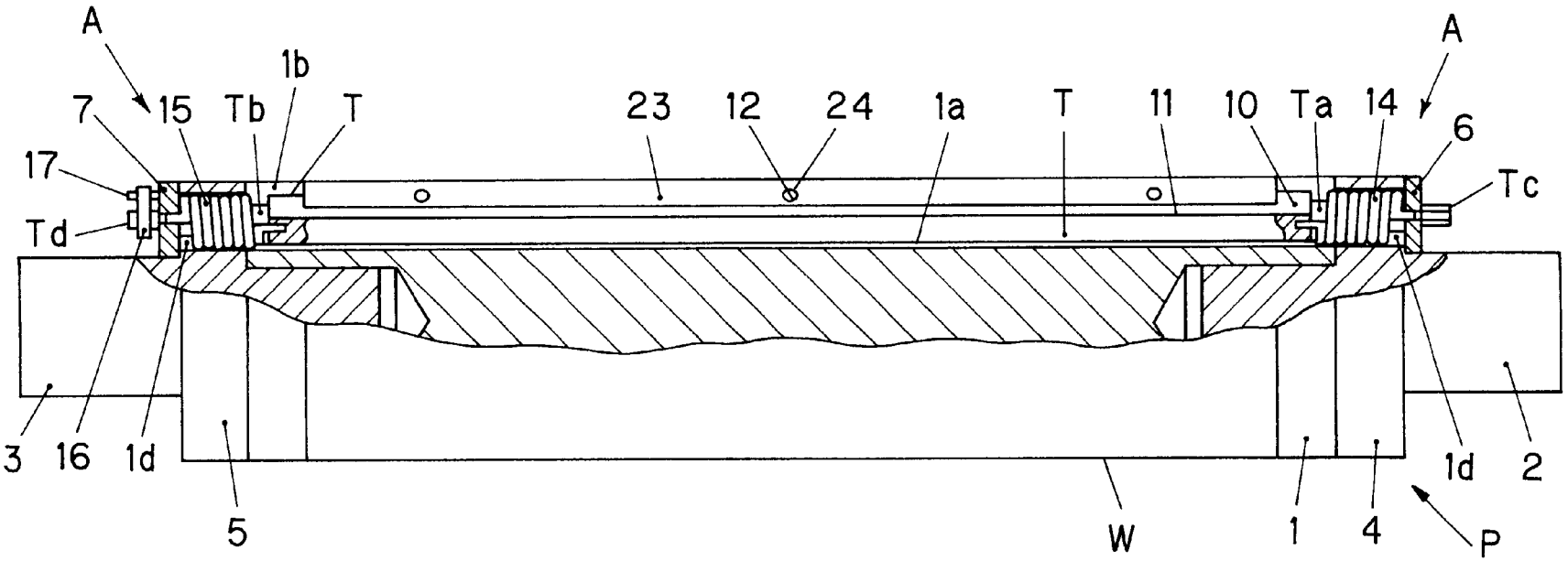
FIG. 1 is a partially sectioned front view of an object attachment apparatus according to an embodiment of the present invention provided on a printing cylinder.

The printing cylinder P of the printing press shown in FIG. 1 is composed of a cylinder body 1 and shaft members 2 and 3 attached to holes formed at the opposite ends of the cylinder body 1. The shaft members 2 and 3 have flange-shaped bearers 4 and 5, respectively, which are formed at respective axially intermediate portions and which have diameters slightly greater than that of the cylinder body 1. Inner end portions of the shaft members 2 and 3 are inserted into the holes of the cylinder body 1 and fixed thereto by use of appropriate means such that the inner side surfaces of the bearers 4 and 5 come into contact with the opposite ends of the cylinder body 1. The outer end portions of the shaft members 2 and 3 serve as journals of the printing cylinder P.

The above-mentioned anchor-shaft hole 1*a* (a circular hole in the illustrated example), into which the anchor shaft T is inserted, is formed in a wall portion of the cylinder body 1 in the vicinity of the outer circumferential surface thereof such that the anchor-shaft hole 1*a* penetrates the cylinder body 1 in the axial direction. Further, an axially-extending groove 1*b* is formed along the anchor hole 1*a* such that the groove 1*b* extends in an outward direction from the anchor-shaft hole 1*a* toward the outer circumferential surface of the cylinder body 1 and opens at the outer circumferential surface, thereby enabling insertion of the opposite edge portions of an object W, which will be described later, into the groove 1*b*.

Figure 2:
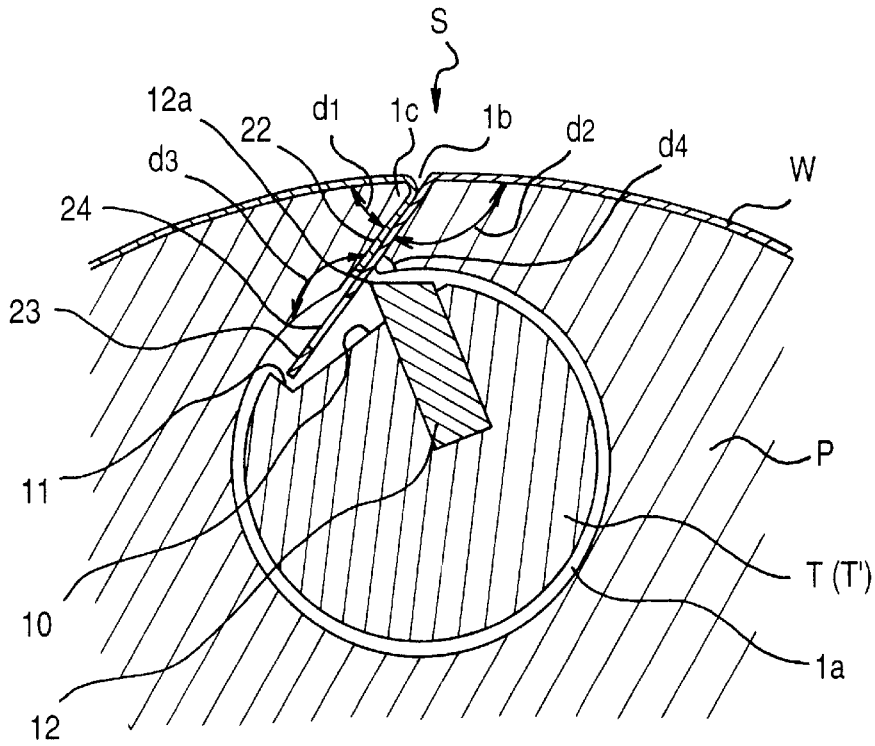
FIG. 2 is a sectional side view used for explaining an operation of attaching a printing plate or blanket (object) to the printing cylinder by use of the object attachment apparatus according to the embodiment (the state at the time of initiation of the attachment operation)

Opposed side wall surfaces which extend longitudinally in order to constitute the groove 1*b* are not necessarily parallel surfaces, but preferably are parallel surfaces, as shown in FIG. 2.

The size of the opening of the groove 1*b* at the outer circumferential surface of the cylinder body 1; i.e., the distance between the parallel wall surfaces shown in FIG. 2, is slightly greater than two times the thickness of each end edge portion of the object W to be inserted into the groove 1*b* for attachment. A first one of the parallel wall surfaces of the groove 1*b* intersects, at an acute angle d1, with a tangent plane passing through a line of intersection between the first wall surface and the outer circumferential surface of the cylinder body 1, thereby forming an edge 1*c* together with the outer circumferential surface of the cylinder body 1. The first wall surface of the groove 1*b* intersects, at an obtuse angle d3, with a tangent plane passing through a line of intersection between the wall surface and the inner circumferential surface of the anchor-shaft hole 1*a*.

Accordingly, the other, or second, wall surface of the groove 1*b* intersects, at an obtuse angle d2 which is substantially equal to the supplementary angle of the acute angle d1, with a tangent plane passing through a line of intersection between the second wall surface and the outer circumferential surface of the cylinder body 1, and intersects, at an acute angle d4 which is substantially equal to the supplementary angle of the obtuse angle d3, with a tangent plane passing through a line of intersection between the wall surface and the inner circumferential surface of the anchor-shaft hole 1*a*.

A hole 1*d* having a diameter substantially the same as that of the anchor-shaft hole 1*a* penetrates each of the bearers 4 and 5 coaxially with the anchor-shaft hole 1*a*.

The anchor shaft T is a bar or rod which has an appropriate cross-sectional shape and a thickness or diametrical dimension such that a proper clearance is formed between the anchor shaft T and the anchor-shaft hole 1*a*. As shown in FIG. 2, the anchor shaft T is preferably a round bar which is slightly smaller in diameter than the anchor-shaft hole 1*a* and which has a larger diameter portion T' located within the anchor-shaft hole 1*a*, smaller diameter portions Ta and Tb extending from the opposite ends of the larger diameter portion T'; and shaft end portions Tc and Td having diameters smaller than those of the smaller diameter portions Ta and Tb.

The larger diameter portion T' is inserted into the anchor-shaft hole 1*a* with a proper clearance formed therebetween; and the smaller diameter portions Ta and Tb are inserted into the holes 1*d* of the bearers 4 and 5 together with rotation force imparting means A, which will be described later. Further, the shaft end portions Tc and Td are rotatably supported by brackets 6 and 7 fixed to the end surfaces of the bearers 4 and 5 such that axial movement thereof is restricted and such that the shaft end portions Tc and Td project outward from the brackets 6 and 7.

The projected portion of the shaft end portion Tc is formed in the shape of a rectangular or hexagonal prism, which allows a worker to rotate the shaft end portion Tc by use of a tool such as a wrench when operating the object attachment apparatus.

An axially extending cutaway having at least two surfaces (a first surface 10 and a second surface 11) is formed on the outer circumferential surface of the larger diameter portion T' of the anchor shaft T. In the embodiment shown in FIG. 2, when the anchor shaft T is located at a predetermined rotational or phase position (angular position), the first surface 10 of the cutaway becomes parallel to a plate extending from the first side wall surface of the groove 1*b*, which forms the edge 1*c* together with the outer circumferential surface of the cylinder body 1, and the distance between the first surface 10 and the plane becomes slightly greater than the clearance of the groove 1*b*. The second surface 11 intersects the first surface 10 at substantially a right angle.

Accordingly, the first surface 10 does not interfere with the end edge portion of the object W inserted into the groove 1*b*, and the second surface 11 can contact the tip of the end edge portion of the object W.

A plurality (three in the illustrated example) of pins 12 are studded in the first surface 10 of the anchor shaft T such that they are aligned in the axial direction at a position away from the second surface 11. The pitch of the pins 12 is set smaller than the length of the end edge portions of the object W. Each of the pins 12 has a cross section taken perpendicular to the longitudinal direction such that at least a portion of the cross section on the second surface 11 side has a curved shape. In the present embodiment, each pin 12 has a circular cross section. Each pin 12 has an inclined tip end surface which does not project radially from the outer circumferential surface of the anchor shaft T and is located at substantially the same radial position as that of the outer circumferential surface. The included tip end surface intersects at an acute angle with a generatrix facing the second surface 11.

The rotational force imparting means A for imparting rotational force to the anchor shaft T is composed of a coil spring 14 (15), an arm 16, and a stopper pin 17.

In the hole 1*d* of the bearer 4, the coil spring 14 is wound around the smaller diameter portion Ta of the anchor shaft T with a slight gap formed between the outer circumferential surface of the smaller diameter portion Ta and the coil spring 14. One end of the coil spring 14 is inserted into or fixed to an attachment hole or groove formed in the bracket 6, and the other end of the coil spring 14 is inserted into or fixed to an attachment hole or groove formed in one side surface of the larger diameter portion T' of the anchor shaft T. Similarly, in the hole 1*d* of the bearer 5, the coil spring 15 is wound around the smaller diameter portion Tb of the anchor shaft T with a slight gap formed between the outer circumferential surface of the smaller diameter portion Tb and the coil spring 15. One end of the coil spring 15 is inserted into or fixed to an attachment hole or groove formed in the bracket 7, and the other end of the coil spring 15 is inserted into or fixed to an attachment hole or groove formed in the other side surface of the larger diameter portion T' of the anchor shaft T.

The arm 16 is attached to the shaft end portion Td such that the arm 16 extends in a radial direction, and the stopper pin 17 is attached to the side surface of the bracket 7 such that the stopper pin 17 extends in the axial direction in order to come into contact with the arm 16.

Accordingly, due to the restoration forces of the coil springs 14 and 15, the anchor shaft T is urged to rotate in the counterclockwise direction in FIG. 2. The relationship in phase position (or angular position) between the arm 16 and the axially extending stopper pin 17 with which the arm 16 comes into contact are determined such that the arm 16 comes into contact with the stopper pin 17 when the anchor shaft T enters the state shown in FIG. 4 (in an object removal position, which will be described later) as a result of being rotated in the clockwise direction in FIG. 4 against the restoration forces of the coil springs 14 and 15.

Figure 5:
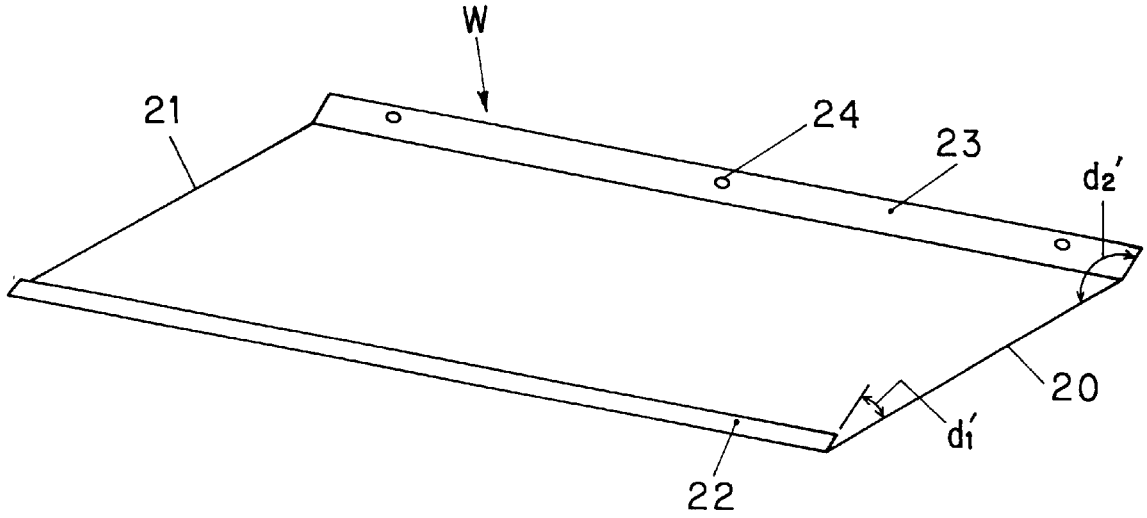
FIG. 5 is a perspective view of an object to be attached to the printing cylinder according to another embodiment of the present invention.

As shown in FIG. 5, which shows the object W in a state of being extended flat, the object W is a rectangular thin plate made of aluminum or iron and having a thickness not greater than 0.5 mm. An image-forming portion is provided on the plate, or a blanket sheet such as a rubber sheet is bonded thereto. The thin plate has lateral side edges 20 and 21 and edge portions located at the opposite ends in the longitudinal direction (direction along which the thin plate is wound around the printing cylinder). At least the side edges 20 and 21 located at opposite sides in the width direction are parallel to each other. The edge portions of the thin plate located at opposite ends in the longitudinal direction (in the direction along which the plate is wound around the printing cylinder) are plate portions; i.e., bare portions of the thin plate on which the image-formation portion and the blanket sheet are not present. The edge portions serve as bending allowances; i.e., first and second bent portions 22 and 23 which are inserted into the groove 1*b* of the printing cylinder P.

The first bent portion 22 of the object W is bent at an angle d1' substantially equal to the acute angle d1 at the edge C1, and the second bent portion 23 of the object W is bent at an angle d2' substantially equal to the obtuse angle d2.

The dimension of the second bent portion 23 in the longitudinal direction (direction along which the thin plate is wound around the printing cylinder) is greater than that of the first bent portion 22, and circular or elliptical anchor holes 24 are formed in a portion of the second bent portion 23 exceeding the dimension of the first bent portion 22 such that the anchor holes 24 are located at positions corresponding to the pins 12 on the first surface 10 of the anchor shaft T in the widthwise direction of the object. The anchor holes 24 have a size such that the pins 12 can enter the anchor holes 24.

Attachment and removal of the object W to and from the printing cylinder P are performed through the following operation.

(1) First, an operator inserts the first bent portion 22 of the object W into the groove 1*b* such that the first bent portion 22 engages the edge 1*c* of the printing cylinder P.

Subsequently, the operator starts the printing press so as to rotate the printing cylinder P slowly in the clockwise direction in FIG. 2. As a result, the object W is gradually wound a round the outer circumferential surface of the printing cylinder P. The operator stops the printing cylinder P when the printing cylinder P has rotated about one turn; i.e., when the object W has been wound completely around the outer circumferential surface of the printing cylinder P.

(2) Subsequently, the operator attaches a tool (not shown) to the shaft end portion Tc of the anchor shaft T shown in FIG. 1, and manually rotates the anchor shaft T in a direction opposing the restoration forces of the coil springs 14 and 15 of the rotational force imparting means A. The operator stops the rotating operation slightly before the arm 16 attached to the shaft end portion Tb comes into contact wit h the stopper pin 17 (FIG. 2).

In this state, the operator inserts the second bent portion 23 of the object W into the groove 1*b*. As a result, the second bent portion 23 enters the groove 1*b* while facing the first bent portion 22. Thus, the object W is brought into an anchor start state (FIG. 2).

(3) Next, the operator gradually rotates the tool attached to the shaft end portion Tc in a direction such that the anchor shaft T is rotated by the rotational force imparting means A; i.e., the anchor shaft T rotates in the counterclockwise direction in FIG. 2.

Figure 3:
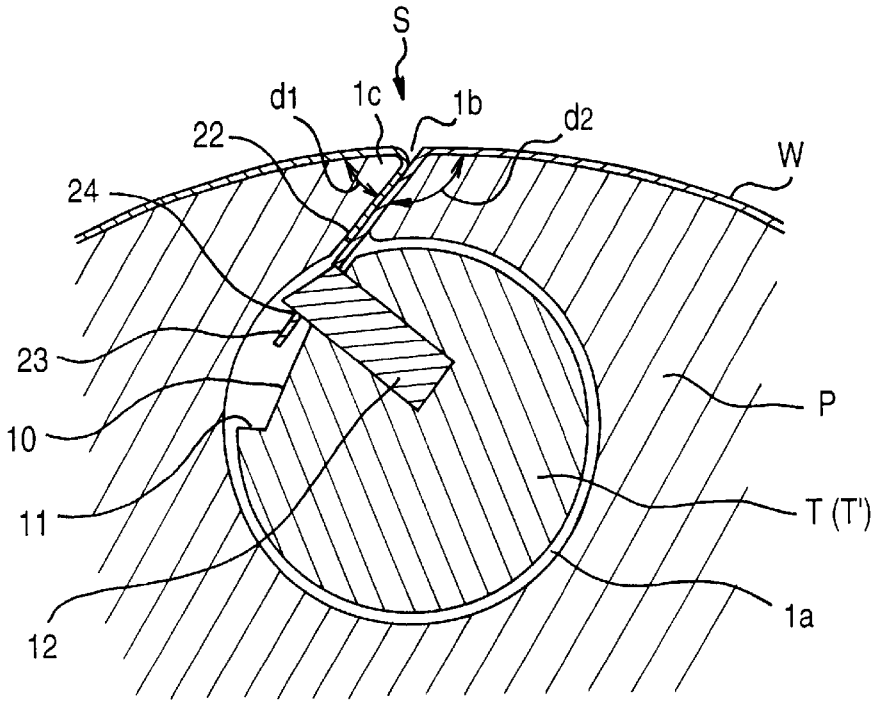
FIG. 3 is a sectional side view used for explaining the operation of attaching the object to the printing cylinder by use of the object attachment apparatus according to the embodiment (the state at the time of completion of the attachment operation)

As a result, as shown in FIG. 3, the sharp end points 12*a* of the pins 12 provided on the anchor shaft T enter the corresponding anchor holes 24 formed in the second bent portion 23. At this time, the second bent portion 23 may be slightly shifted in the axial direction or may fail to have completely entered the groove 1*b*. However, even in such a state, engagement between the pins 12 and the anchor holes 24 can be established without fail, because the pins 12 have a circular cross section, and the anchor holes 24 have a circular shape. Specifically, once the sharp end points 12*a* of the pins 12 slightly enter the anchor holes 24, the outer circumferential surfaces of the pins 12 come into contact with the inner circumferential surfaces of the anchor holes 24. With angular displacement of the pins 12, the pins 12 enter the anchor holes 24 of the second bent portion 23 more deeply, and the second bent portion 23 is pulled toward the deeper side of the groove 1*b*.

The rotation of the anchor shaft T stops at a position where the rotational force generated by the rotational force imparting means A is balanced with the tension of the object W. Thus, the attachment of the object W to the printing cylinder P is completed. Subsequently, the operator removes the tool from the shaft end portion Tc.

(4) Removal of the object W from the printing cylinder P is performed as follows. The operator attaches the tool to the shaft end portion Tc and rotates the anchor shaft T in the direction opposing the rotational force generated by the rotational force imparting means A; i.e., in the clockwise direction, to an end point.

Figure 4:
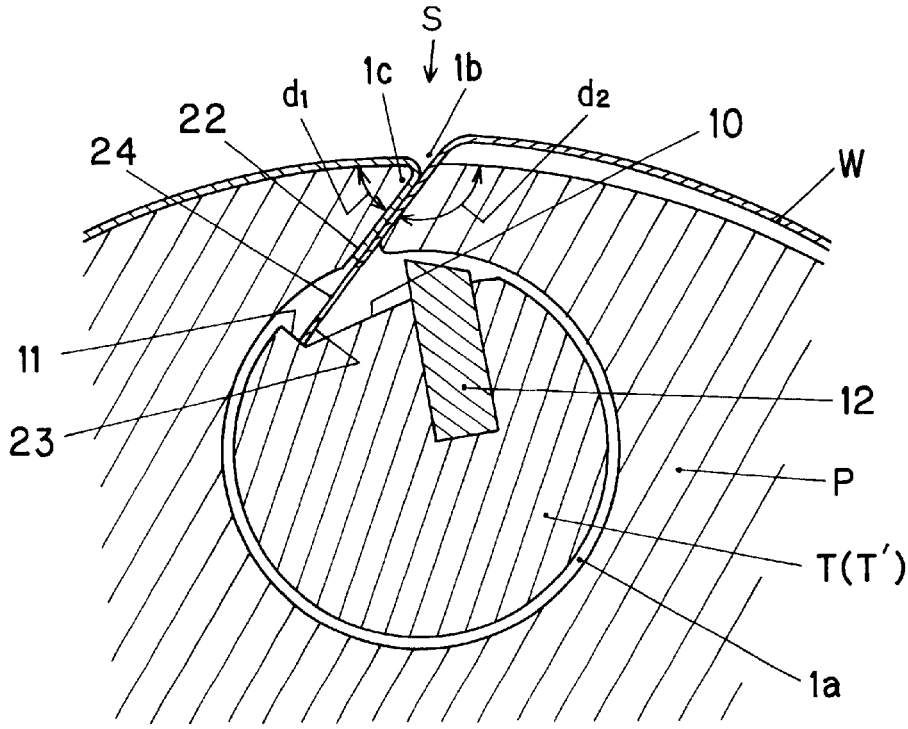
FIG. 4 is a sectional side view used for explaining an operation of removing the object from the printing cylinder by use of the object attachment apparatus according to the embodiment.

The anchor shaft T stops when the arm 16 attached to the shaft end portion Tb comes into contact with the stopper pin 17. While the anchor shaft T rotates, the pins 12 come out of the anchor holes 24 of the second bent portion 23. Subsequently, the second surface 11 pushes the tip end side of the second bent portion 23 to thereby separate the base portion of the second bent portion 23 from the outer circumferential surface of the printing cylinder P (FIG. 4).

Since a clearance is formed between the object W and outer circumferential surface of the printing cylinder P, the operator can remove the second bent portion 23 from the groove 1*b* and remove the object W from the printing cylinder P.

(5) Subsequently, the operator allows the stopped anchor shaft T to rotate due to the rotational force of the rotational force imparting means A. When the anchor shaft T stops due to loss of the rotational force or due to engagement of the arm 16 with the stopper pin 17, the operator removes the tool from the shaft end portion Tc.

(6) Subsequently, the operator starts the printing press to thereby rotate the printing cylinder P slowly in the direction opposite the direction for attachment of the object W to the printing cylinder P, and gradually removes the object W from the circumferential surface of the printing cylinder P.

The operator stops the printing cylinder P when the printing cylinder P has rotated about one turn, and removes the first bent portion 22 of the object W from the groove 1*b* of the printing cylinder P, thereby ending the removal operation.

Obviously, numerous modifications and variations of the present invention are possible in light of the above teachings. It is therefore to be understood that within the scope of the appended claims, the present invention may be practiced otherwise than as specifically described herein.

What is claimed is:

1. An object attachment apparatus for a printing cylinder adapted to anchor parallel edge portions of an object located at opposite ends thereof in a winding direction of the object, after the object is wound around an outer circumferential surface of the printing cylinder, the object attachment apparatus comprising, in combination:

a printing cylinder having an anchor-shaft hole formed in the vicinity of the outer circumferential surface thereof such that the anchor-shaft hole penetrates the printing cylinder in an axial direction;

a groove formed in the printing cylinder such that the groove extends outwardly from the anchor-shaft hole and opens at the outer circumferential surface of the printing cylinder to thereby provide a gap into which the opposite end edge portions of the object can be inserted, one wall surface of the groove intersecting, at an acute angle, a tangent plane passing through a line of intersection between the one wall surface and the outer circumferential surface of the printing cylinder, thereby cooperating with the outer circumferential surface of the printing cylinder to form an edge;

an anchor shaft mounted for rotatable movement in the anchor-shaft hole, the anchor shaft having a cutaway in order to prevent the outer circumferential surface of the anchor shaft from interfering with an object which is inserted into the groove when the anchor shaft is positioned at a predetermined angular position, the cutaway having at least a first substantially planar surface which faces, but is to be separated from, the object when it is inserted into the groove with the anchor shaft being positioned at the predetermined angular position, and a second surface substantially perpendicularly disposed with respect to the first surface to come into contact with the tip end of an object inserted into the groove when the anchor shaft is rotated from the predetermined angular position;

a plurality of pins being fixedly studded in the first surface of the anchor shaft such that the pins are aligned in the axial direction at an interval smaller than the length of the end edge portion of an object to be inserted into the groove, the tip end of each pin projecting from the first surface and being engagable with the object when the anchor shaft is rotated from the predetermined angular position; and a rotational force imparting means for imparting a rotational force to the anchor shaft such that the anchor shaft rotates in such a direction that the second surface of the cutaway of the anchor shaft moves away from the opening of the groove and the tip ends of the pins come into contact with an object inserted into the groove.

2. The object attachment apparatus for a printing cylinder as recited in claim 1 wherein at least a portion of the outer circumferential surface of the pin faces the second surface side of the cutaway.

* * * * *